US010607472B1

(12) United States Patent
Sou et al.

(10) Patent No.: US 10,607,472 B1
(45) Date of Patent: Mar. 31, 2020

(54) SMART LOCK SYSTEM

(71) Applicant: International Business Machines Corporation, Armonk, NY (US)

(72) Inventors: Socheat Sou, Tucson, AZ (US); Daniel Thys Bajema, Lake Elsinore, CA (US); Brian C. De Guia, Tucson, AZ (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 16/165,976

(22) Filed: Oct. 19, 2018

(51) Int. Cl.
*G08B 25/00* (2006.01)

(52) U.S. Cl.
CPC ..... *G08B 25/006* (2013.01); *G08B 25/001* (2013.01)

(58) Field of Classification Search
CPC ..... G07C 2209/62
See application file for complete search history.

(56) References Cited

U.S. PATENT DOCUMENTS

| | | | | |
|---|---|---|---|---|
| 4,114,412 | A | 9/1978 | Braatz | |
| 4,329,681 | A | 5/1982 | Parsons | |
| 4,772,876 | A | 9/1988 | Laud | |
| 5,686,886 | A | 11/1997 | Stensney | |
| 6,950,018 | B2 | 9/2005 | Merrell et al. | |
| 9,396,599 | B1 * | 7/2016 | Malhotra | G07C 9/00174 |
| 9,509,843 | B1 | 11/2016 | Baross | |
| 2012/0092161 | A1 | 4/2012 | West | |
| 2013/0009749 | A1 | 1/2013 | Vijayaraghavan et al. | |
| 2017/0234036 | A1 * | 8/2017 | Ebner | G07C 9/00571 70/51 |
| 2018/0068541 | A1 * | 3/2018 | Almomani | G07C 9/00174 |
| 2018/0336746 | A1 * | 11/2018 | Zhong | E05B 47/00 |
| 2019/0130684 | A1 * | 5/2019 | Bryla | G07C 9/00 |

FOREIGN PATENT DOCUMENTS

| | | |
|---|---|---|
| CN | 201802165 U | 4/2011 |
| CN | 203729827 U | 7/2014 |

OTHER PUBLICATIONS

Sastry et al., "An Efficient Design Framework for Building Alerting Systems to Make Regular tags Intelligent," International Journal of Advanced Research in Computer Science, vol. 3, No. 3, May-Jun. 2012, pp. 345-348.
Gong et al., "The Design of Smart Home Security Alarm Monitoring Based on Jess," Applied Mechanics and Materials, vol. 135-136, 2012, pp. 1044-1050.
Master Lock, "Access. Remastered," Master Lock, 2018, 4 pages, retrieved from https://www.masterlock.com/bluetooth.

* cited by examiner

*Primary Examiner* — Fabricio R Murillo Garcia
(74) *Attorney, Agent, or Firm* — Zilka-Kotab, P.C.

(57) ABSTRACT

A method according to one embodiment includes detecting, by a security, device, an event indicative of a potential security breach. The method also includes determining at least one other device to receive an alert indicating occurrence of the event in response to detecting the event. The method includes sending, by the security device, an alert indicating occurrence of the event to the at least one other device in response to detecting the event. A method according to another embodiment includes monitoring, by a security device, for an event indicative of a potential security breach. The method also includes receiving, by the security device, an alert indicating occurrence of a potential security breach from a second security device. The method includes changing a state of the security device in response to receiving the alert.

18 Claims, 4 Drawing Sheets

SMART LOCK SYSTEM

BACKGROUND

The present invention relates to a smart lock system that monitors and reports status and error conditions, and more specifically, this invention relates to methods and systems for detecting, storing, and alerting status or error conditions in a smart lock system.

Conventional security systems may be equipped with a variety of sensors for detecting conditions. Some security devices set off alarms when conditions occur. An example of such a security device is a fire alarm that sounds when a smoke detector detects a threshold level of heat, ionization, and/or photoelectric data. Security devices are often limited by the types of sensors included and simple alerting mechanisms.

SUMMARY

A method according to one embodiment includes detecting, by a security, device, an event indicative of a potential security breach. The method also includes determining at least one other device to receive an alert indicating occurrence of the event in response to detecting the event. The method includes sending, by the security device, an alert indicating occurrence of the event to the at least one other device in response to detecting the event.

A method according to one embodiment includes monitoring, by a security device, for an event indicative of a potential security breach. The method also includes receiving, by the security device, an alert indicating occurrence of a potential security breach from a second security device. The method includes changing a state of the security device in response to receiving the alert.

A computer program product according to one embodiment includes a computer readable storage medium having program instructions embodied therewith. The program instructions are executable by a security device to cause the security device to perform a method that includes monitoring, by the security device, for an event indicative of a potential security breach. The method also includes receiving, by the security device, an alert indicating occurrence of a potential security breach from a second security device. The method includes changing a state of the security device in response to receiving the alert.

Other aspects and embodiments of the present invention will become apparent from the following detailed description, which, when taken in conjunction with the drawings, illustrate by way of example the principles of the invention.

DETAILED DESCRIPTION

The following description is made for the purpose of illustrating the general principles of the present invention and is not meant to limit the inventive concepts claimed herein. Further, particular features described herein can be used in combination with other described features in each of the various possible combinations and permutations.

Unless otherwise specifically defined herein, all terms are to be given their broadest possible interpretation including meanings implied from the specification as well as meanings understood by those skilled in the art and/or as defined in dictionaries, treatises, etc.

It must also be noted that, as used in the specification and the appended claims, the singular forms "a," "an" and "the" include plural referents unless otherwise specified. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The following description discloses several preferred embodiments of systems, methods and computer program products for detecting, storing, and alerting status and/or error conditions in a smart lock system.

In one general embodiment, a method includes detecting, by a security, device, an event indicative of a potential security breach. The method also includes determining at least one other device to receive an alert indicating occurrence of the event in response to detecting the event. The method includes sending, by the security device, an alert indicating occurrence of the event to the at least one other device in response to detecting the event.

In another general embodiment, a method includes monitoring, by a security device, for an event indicative of a potential security breach. The method also includes receiving, by the security device, an alert indicating occurrence of a potential security breach from a second security device. The method includes changing a state of the security device in response to receiving the alert.

In another general embodiment, a computer program product includes a computer readable storage medium having program instructions embodied therewith. The program instructions are executable by a security device to cause the security device to perform a method that includes monitoring, by the security device, for an event indicative of a potential security breach. The method also includes receiving, by the security device, an alert indicating occurrence of a potential security breach from a second security device. The method includes changing a state of the security device in response to receiving the alert.

Figure 1:
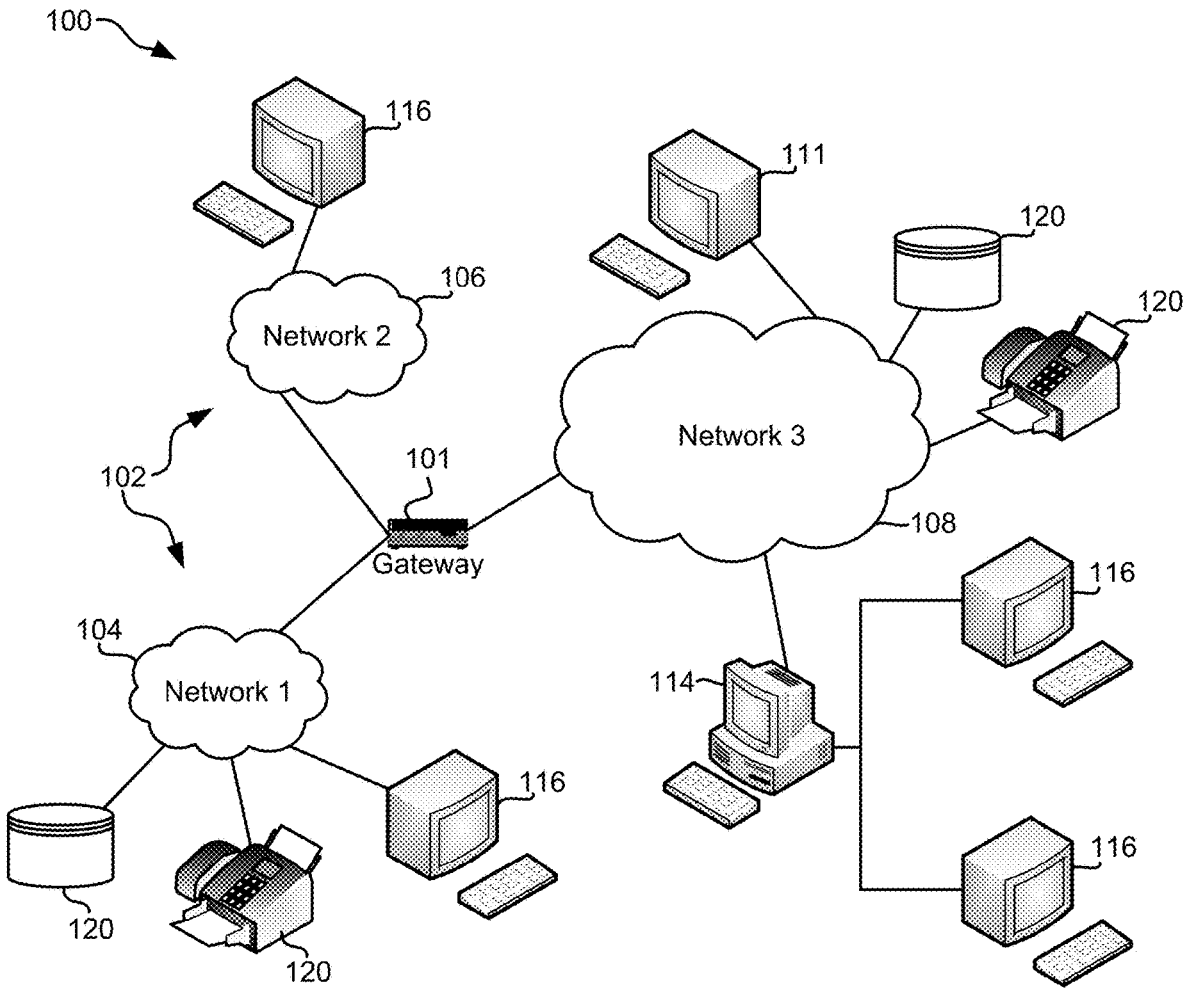
FIG. 1 illustrates a network architecture, in accordance with one embodiment.

FIG. 1 illustrates an architecture 100, in accordance with one embodiment. As shown in FIG. 1, a plurality of remote networks 102 are provided including a first remote network 104 and a second remote network 106. A gateway 101 may be coupled between the remote networks 102 and a proximate network 108. In the context of the present architecture 100, the networks 104, 106 may each take any form including, but not limited to a local area network (LAN), a wide area network (WAN) such as the Internet, public switched telephone network (PSTN), internal telephone network, etc.

In use, the gateway 101 serves as an entrance point from the remote networks 102 to the proximate network 108. As such, the gateway 101 may function as a router, which is capable of directing a given packet of data that arrives at the gateway 101, and a switch, which furnishes the actual path in and out of the gateway 101 for a given packet.

Further included is at least one data server 114 coupled to the proximate network 108, and which is accessible from the remote networks 102 via the gateway 101. It should be noted that the data server(s) 114 may include any type of computing device/groupware. Coupled to each data server 114 is a plurality of user devices 116. User devices 116 may also be connected directly through one of the networks 104, 106, 108. Such user devices 116 may include a desktop computer, lap-top computer, hand-held computer, printer or any other type of logic. It should be noted that a user device 111 may also be directly coupled to any of the networks, in one embodiment.

A peripheral 120 or series of peripherals 120, e.g., security devices, facsimile machines, printers, networked and/or local storage units or systems, etc., may be coupled to one or more of the networks 104, 106, 108. It should be noted that databases and/or additional components may be utilized with, or integrated into, any type of network element coupled to the networks 104, 106, 108. In the context of the present description, a network element may refer to any component of a network.

According to some approaches, methods and systems described herein may be implemented with and/or on virtual systems and/or systems which emulate one or more other systems, such as a UNIX system which emulates an IBM z/OS environment, a UNIX system which virtually hosts a MICROSOFT WINDOWS environment, a MICROSOFT WINDOWS system which emulates an IBM z/OS environment, etc. This virtualization and/or emulation may be enhanced through the use of VMWARE software, in some embodiments.

In more approaches, one or more networks 104, 106, 108, may represent a cluster of systems commonly referred to as a "cloud." In cloud computing, shared resources, such as processing power, peripherals, software, data, servers, etc., are provided to any system in the cloud in an on-demand relationship, thereby allowing access and distribution of services across many computing systems. Cloud computing typically involves an Internet connection between the systems operating in the cloud, but other techniques of connecting the systems may also be used.

Figure 2:
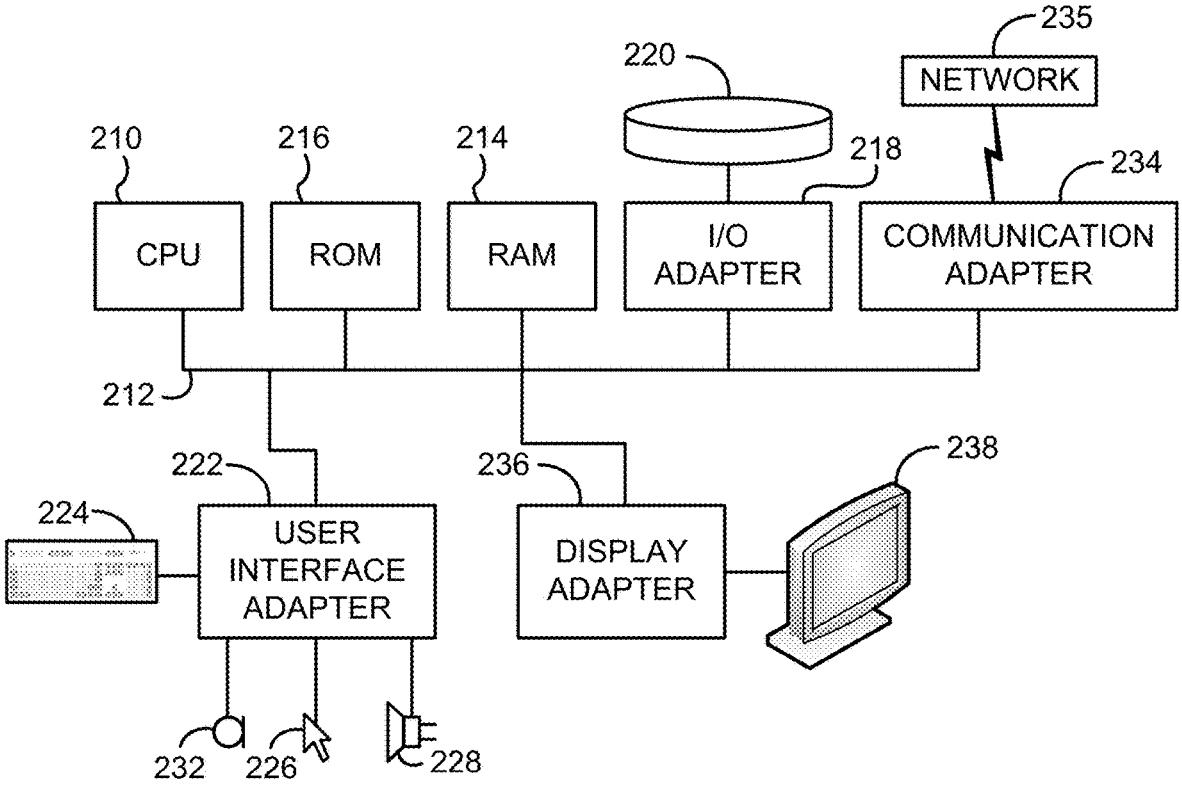
FIG. 2 shows a representative hardware environment that may be associated with the servers and/or clients of FIG. 1, in accordance with one embodiment.

FIG. 2 shows a representative hardware environment associated with a user device 116 and/or server 114 of FIG. 1, in accordance with one embodiment. Such figure illustrates a typical hardware configuration of a workstation having a central processing unit 210, such as a microprocessor, and a number of other units interconnected via a system bus 212.

The workstation shown in FIG. 2 includes a Random Access Memory (RAM) 214, Read Only Memory (ROM) 216, an input/output (I/O) adapter 218 for connecting peripheral devices such as disk storage units 220 to the bus 212, a user interface adapter 222 for connecting a keyboard 224, a mouse 226, a speaker 228, a microphone 232, and/or other user interface devices such as a touch screen and a digital camera (not shown) to the bus 212, communication adapter 234 for connecting the workstation to a communication network 235 (e.g., a data processing network) and a display adapter 236 for connecting the bus 212 to a display device 238.

The workstation may have resident thereon an operating system such as the Microsoft Windows® Operating System (OS), a MAC OS, a UNIX OS, etc. It will be appreciated that a preferred embodiment may also be implemented on platforms and operating systems other than those mentioned. A preferred embodiment may be written using eXtensible Markup Language (XML), C, and/or C++ language, or other programming languages, along with an object oriented programming methodology. Object oriented programming (OOP), which has become increasingly used to develop complex applications, may be used.

Figure 3:
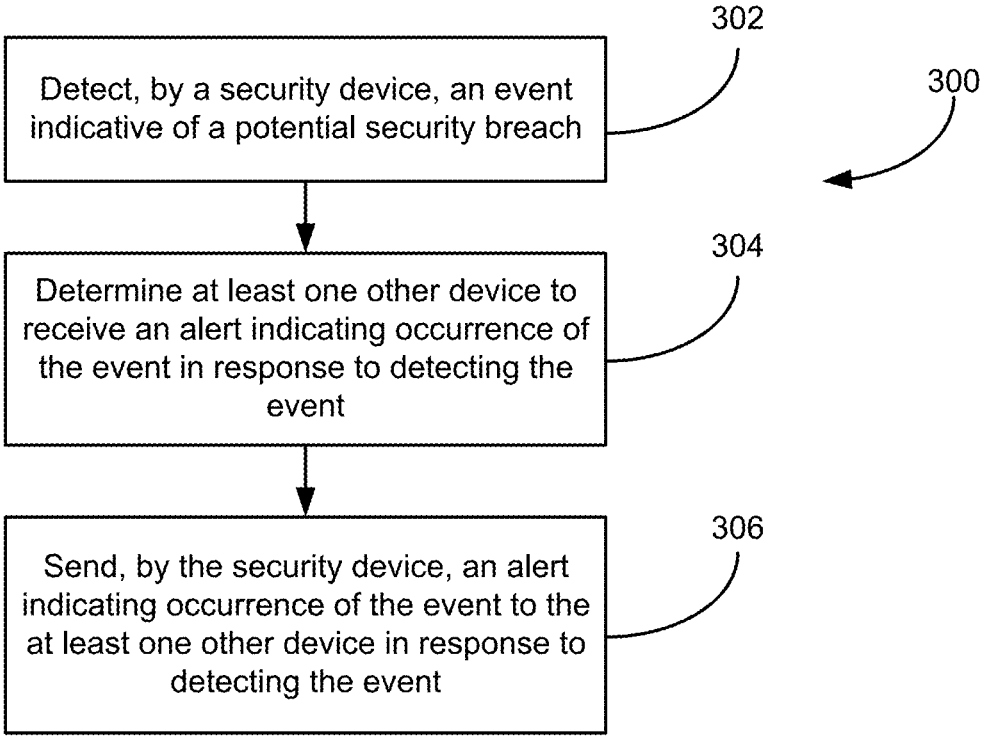
FIG. 3 illustrates a flowchart of a method in accordance with one embodiment.

Now referring to FIG. 3, a flowchart of a method 300 is shown according to one embodiment. The method 300 may be performed in accordance with the present invention in any of the environments depicted in FIGS. 1-2 and 4, among others, in various embodiments. Of course, more or less operations than those specifically described in FIG. 3 may be included in method 300, as would be understood by one of skill in the art upon reading the present descriptions.

Each of the steps of the method 300 may be performed by any suitable component of the operating environment. For example, in various embodiments, the method 300 may be partially or entirely performed by computer, or some other device having one or more processors therein. The processor, e.g., processing circuit(s), chip(s), and/or module(s) implemented in hardware and/or software, and preferably having at least one hardware component may be utilized in any device to perform one or more steps of the method 300. Illustrative processors include, but are not limited to, a central processing unit (CPU), an application specific integrated circuit (ASIC), a field programmable gate array (FPGA), etc., combinations thereof, or any other suitable computing device known in the art.

As shown in FIG. 3, method 300 may initiate with operation 302, where the method 300 includes detecting by a security device, an event indicative of a potential security breach. A potential security breach may be effected on the device itself, an object to be protected by the security device, an area to be protected by the security device, etc.

In one embodiment, an event indicative of a potential security breach is an event indicative of an action performed on the security device itself such as through tampering. Tampering with a security device may include lock picking, crushing, and/or otherwise deforming and/or manipulating a security device. Tamper sensing may be performed using sensors of known type, such as a lock pick sensor, a circuit that detects whether a bolt of a lock was cut, a force sensor that detects if excessive force was applied to the lock, etc. In another embodiment, tampering with the security device includes a breach of the security device. A breach of the security device may include cutting the lock, kicking a door open, other applications of brute force that result in the opening and/or destruction of the security device, prying the lock open and apart, etc.

In another embodiment, an event indicative of a potential security breach is an event indicative of an action performed in the vicinity of the security device. The action performed in the vicinity of the security device may be motion and/or sound in a restricted area. The detection of motion and/or sound may be based on predetermined motions and/or sounds, detection of any motion and/or sound where none were anticipated, etc. An action performed in the vicinity of the security device may be detected via an image capture device, a motion sensor, a sound recording device, or any other monitoring device known in the art. The vicinity of the security device may include a restricted area in a home, office, building, vehicle, or any other enclosure to be monitored that would be known to one having ordinary skill in the art. The vicinity of the security device may be defined as any distance between the security device and the object and/or area to be monitored and/or protected.

Sensors may be implemented to detect actions such as actions effected on the security device, actions effected an object to be protected by the security device, actions performed in an area to be protected by the security device, etc. One or more sensors may be implemented in the security devices. Sensors may include door and/or window contact sensors, pressure sensors, motion sensors, glass break sensors, shock sensors, vibration sensors, smoke sensors, heat sensors, carbon dioxide sensors, freeze sensors, flood sensors, cameras or image sensors, sound sensors, or any other sensor known in the art.

Operation 304 of method 300 includes determining at least one other device to receive an alert indicating occurrence of the event in response to detecting the event. In one embodiment, determining at least one other device to receive an alert indicating occurrence of the event includes retrieving information about the other device from memory; determining whether another device is reachable by the security device, e.g., directly via wiring and/or an air interface, via a network, etc.; requesting identities of the other device(s) from a remote computer; etc. In other embodiments, more complex configurations include selecting specific devices from a list based on the type of event that was detected.

The other device(s) determined in operation 304 may be one or more subscribers. Illustrative subscribers may include other security devices, personal use devices such as cell phones, a computer system for a building, a computer system associated with a security service, etc. Other security devices may include security devices originating from the same manufacturer and/or security devices originating from a different manufacturer.

Operation 306 of method 300 includes sending, by the security device, an alert indicating occurrence of the event to the at least one other device in response to detecting the event. In one embodiment, the alert indicating occurrence of the event is sent directly to the at least one other security device in response to detecting the event. In other embodiments, the alert indicating occurrence of the event is sent via direct connection, via a network including a fixed broadband internet, mobile network, virtual private network (VPN), local area network (LAN), direct networks, etc. In an exemplary embodiment, the alert may be sent via Bluetooth, Wi-Fi, RFID, etc.

In another embodiment, an alert indicating occurrence of an event may be sent, e.g., broadcast, to a list of subscribers, e.g., as described above.

If multiple security devices detect an event and/or occurrence, an alert may be sent including information describing each event from each security device.

The alert may include metadata associated with the event. Metadata may include descriptive metadata, structural metadata, administrative metadata, reference metadata and/or statistical metadata or any other type of metadata known in the art. In one embodiment, the alert may include a timestamp of the event. In another embodiment, the alert may include positional and/or direction information about the event.

In another embodiment, the alert is indicative of a probability of the event being an actual security breach. The alert may be indicative of a probability of the event being an actual security breach according to the categorization of the alert. Examples of categorizations of alerts may include warning conditions, informational conditions, critical conditions, simple warnings, and/or critical warnings.

For example, an alert may be a simple warning if there is no indication of force, etc. that would be indicative of tampering. A simple alert may also indicate that the security device is operating normally and/or was opened via an expected method. The security device may be opened and/or unlocked correctly via an expected method. An expected method may include the use of a key, keypad combination, an alphanumeric password, traced or untraced patterns, fingerprint, facial recognition, or other biometric authentication methods, etc. A user may still wish to be alerted to these instances if a key has gone missing, the secrecy of the combination and/or password has been breached, etc. An alert may be a critical alert if there is indication that the security device was forcibly unlocked and/or tampered with.

In other embodiments, the alerts may, in addition to reporting the conditions, report the circumstances of how the security device was breached. An alert may further differentiate and/or report whether the event indicative of a potential security breach was an attempted security breach or a completed security breach.

For example, the alert may include a simple warning that specifies whether it is likely a door was opened via an expected method that is not indicative of tampering, e.g., the door was opened unexpectedly, but a tamper sensor on security device for the door did not detect tampering. An expected method for a door opening that is not indicative of tampering may include wind pushing the door open. Alternatively, the alert may be a critical alert that describes a predefined event such as tampering, lock picking, application of brute force, etc. detected by the security device. The alert may report that such tampering constituted an attempted security breach if the security device remains operable. The alert may report that such tampering constituted an attempted security breach if the security device remains intact. The alert may report that a completed security breach occurred where the security device has been breached, for example through cutting or brute force, that renders the security device inoperable.

In one embodiment, the alert is sent to at least one other security device. The at least one other security device may include an additional camera, lock, alarm, sensor, etc. A plurality of security devices may form a network of security devices that are capable of communicating with each other. There may be multiple networks of multiple security devices. Various systems of security devices may send alerts to other security devices or other systems as necessary. The security devices may be any combination of types of security devices including security devices originating from the same manufacturer and/or from a different manufacturer.

In one embodiment, the alert is sent directly to at least one other security device. In another embodiment, the alert is sent directly to a coordinator that sends the alert to at least one other security device. The coordinator may be a central computer that coordinates sending of alerts, a cloud-based server, etc.

In one embodiment, the at least one other security device is of the same type as the security device. This configuration may include a camera to camera, lock to lock, sensor to sensor, etc. The same type as the security device may mean the same type of device and/or the same manufacturer as the first security device.

In another embodiment, the security device is at a first building, where at least one of the other security devices is at a second building. A building may be a home, business, school, office, or any other enclosure to be monitored which is separated from another security device at another building. The alert may be sent to a remote location. The at least one other security device may include any other security devices, mobile devices, security devices from a list of subscribers originating from the same manufacturer and/or a different manufacturer, etc.

In a further embodiment, the security device is a lock, wherein at least one of the other security devices is a lock at a same geographical location as the security device.

An example of a plurality of security devices that are locks in the same location may occur in a locker room setting where people bring and use their own padlocks. Often, it is not feasible to have an employee monitor all the lockers at all times. The alerts from one security device (i.e. a lock within the locker room) may be sent to other security devices in the locker room or other security devices authorized to receive such alerts such as the gym's front desk computer system. A security guard or employee of the gym may receive an alert and follow up on the alert without the need to constantly monitor all the security devices. Additionally, other gym users may subscribe their security devices to receive alerts and notifications when a potential security breach is effected on another security device in the vicinity.

In an additional embodiment, the method may include determining a state of other security devices in communication with the security device and sending information about the states with the alert. In one embodiment, security devices in communication with other security devices may be configured to send alerts and/or instructions to other security devices the system is aware of. An example of this embodiment may include a security device on an office door which may report an error condition and/or instructions to other security devices on other doors in the building. If multiple security devices detect an event and/or occurrence, an alert may be sent including information describing each event from each security device.

Figure 4:
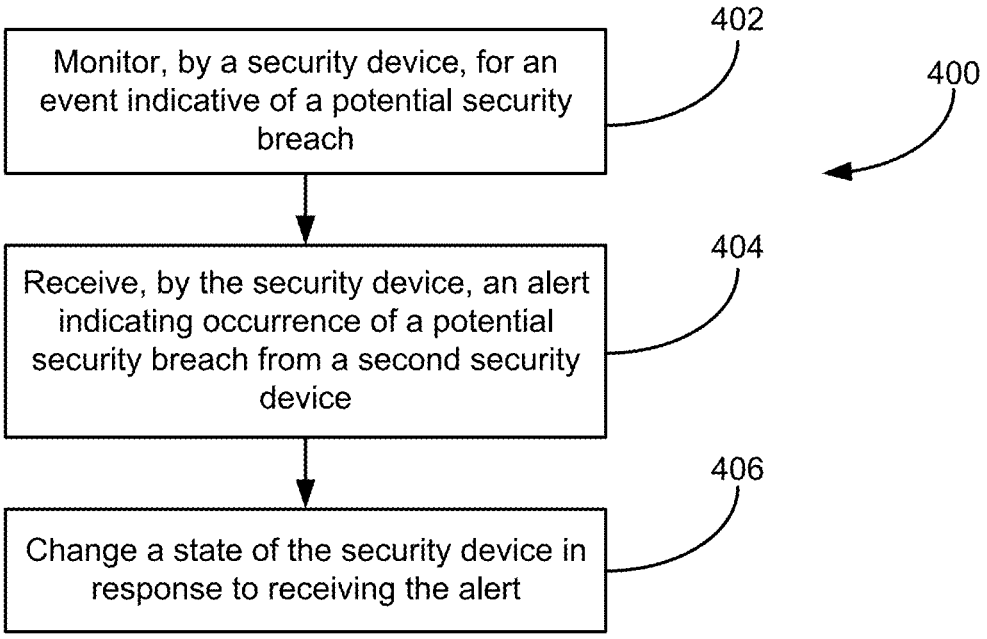
FIG. 4 illustrates a flowchart of a method in accordance with one embodiment.

Now referring to FIG. 4, a flowchart of a method 400 is shown according to one embodiment. The method 400 may be performed in accordance with the present invention in any of the environments depicted in FIGS. 1-3, among others, in various embodiments. Of course, more or less operations than those specifically described in FIG. 4 may be included in method 400, as would be understood by one of skill in the art upon reading the present descriptions.

Each of the steps of the method 400 may be performed by any suitable component of the operating environment. For example, in various embodiments, the method 400 may be partially or entirely performed by computer, or some other device having one or more processors therein. The processor, e.g., processing circuit(s), chip(s), and/or module(s) implemented in hardware and/or software, and preferably having at least one hardware component may be utilized in any device to perform one or more steps of the method 400. Illustrative processors include, but are not limited to, a central processing unit (CPU), an application specific integrated circuit (ASIC), a field programmable gate array (FPGA), etc., combinations thereof, or any other suitable computing device known in the art.

As shown in FIG. 4, method 400 may initiate with operation 402, where the method 400 includes monitoring, by a security device, for an event indicative of a potential security breach. Monitoring by the security device may be performed using sensors such as door and/or window contact sensors, pressure sensors, motion sensors, glass break sensors, shock sensors, vibration sensors, smoke sensors, heat sensors, carbon dioxide sensors, freeze sensors, flood sensors, cameras or image sensors, sound sensors, lock pick sensors, or any other sensor known in the art. One or more sensors may be used for monitoring for events indicative of a security breach in any combination.

Operation 404 of method 400 includes receiving, by the security device, an alert indicating the occurrence of a potential security breach from a second security device. In one embodiment, the alert indicating occurrence of the event is received directly by the security device. In another embodiment, the alert indicating occurrence of the event is received via direct connection, via a network including a fixed broadband internet, mobile internet, virtual private network (VPN), local area network (LAN), direct networks, etc. In an exemplary embodiment, the alert may be received via Bluetooth, Wi-Fi, RFID, etc.

The alert may include metadata associated with the event. Metadata may include descriptive metadata, structural metadata, administrative metadata, reference metadata and/or statistical metadata or any other type of metadata known in the art. In one embodiment, the alert may include a timestamp of the event. In another embodiment, the alert may include positional and/or direction information about the event.

In another embodiment, the alert is indicative of a probability of the event being an actual security breach. The alert may be indicative of a probability of the event being an actual security breach according to the categorization of the alert. Examples of categorizations of alerts may include warning conditions, informational conditions, critical conditions, simple warnings, and/or critical warnings.

An alert may be a simple warning if there is no indication of force, etc. that would be indicative of tampering. A simple alert may also indicate that the security device is operating normally and/or was opened via an expected method. An expected method may include the use of a key, keypad combination, an alphanumeric password, traced or untraced patterns, fingerprint, facial recognition, or other biometric authentication methods, etc. A user may still wish for his or her security device to be alerted to these instances if a key has gone missing, the secrecy of the combination and/or password has been breached, etc. An alert may be a critical alert if there is indication that the security device was forcibly unlocked or tampered with.

In other embodiments, the alerts may, in addition to reporting the conditions, report the circumstances of how the security device was breached. An alert may further differentiate and/or report whether the event indicative of a potential security breach was an attempted security breach or a completed security breach.

In one embodiment, a plurality of receiving and/or sending security devices may form an ad hoc network. The ad hoc network may be formed in a neighborhood, in a building, or any other area the security devices may be used to monitor error conditions such as attempted security breaches, etc. The ad hoc network may be further used to create an epicenter map of events and/or occurrences in the ad hoc network. A smart community grid may result in net protection of the buildings and/or enclosures in the network. The ad hoc network may detect, report, receive, and/or store events from individual security devices in the network.

Operation 406 of method 400 includes changing a state of the security device in response to receiving the alert. Changing a state of the security device may include changing a lock from an unlocked position to a locked position or vice versa, changing the setting for recording from non-recording to constant recording or event-only recording, changing the direction that the camera faces, etc.

In one embodiment, the security device includes a camera, where changing the state includes saving a constant recording for a period of time. The period of time may be predefined based on the type of event indicative of a potential security breach, a standard setting, a period of time set by a user, or any other period of time that may be contemplated in response to the event indicative of a potential security breach. The period of time may be defined and/or terminated by a reset, an all-clear alert sent from the user, an all-clear alert sent by other security devices, the end of the predetermined time period, etc.

In one example of changing a state of the security device, consider a security device on a door at an office building which receives an alert containing an error condition from another security device on another door at the same building. In response to receiving the alert, the receiving security device may change its state from unlocked to locked, from non-recording to recording, increase sensitivity settings, etc. The security device may also include a camera that may change position (e.g. in order to view an exit of the building instead of the hallway).

In other embodiments, changing the state of the security devices may include enhancing the monitoring by the security device. Enhancing the monitoring by the security device may include modifying the settings on the security device by switching from no recording to constant recording, switching from event-only recording to constant recording for a period of time, increasing the sensitivity settings of the security device, etc.

An example of increasing the sensitivity of settings of a security device includes changing a setting of a glass break sensor. Under normal conditions, the settings may be set to a "Low" setting so that the sensor ignores innocuous sounds such as wind chimes. Upon receiving an alert from another security device indicating a potential security breach, the settings of the glass break sensor may be set to a higher sensitivity (e.g. a "High" setting).

In one embodiment, enhancing the monitoring by security devices includes lowering the thresholds for error once tampering is detected. Lowering thresholds for error may include reducing the number of unlock attempts available, increasing the sensitivity of any tamper detection methods and/devices, reducing the threshold loudness for volume detection, etc.

An example of this embodiment describes security devices in a home security system that may detect an intrusion attempt. A security device detecting an event indicative of security breach may send out alerts to other security devices in the network or to other security devices in the neighborhood if those security devices are subscribed to receive such alerts. The plurality of security devices within the neighborhood may form an ad hoc network. The receiving security devices may enhance monitoring accordingly. Specifically, if an intrusion attempt occurs at House A, the security devices in House A would respond as normal and additionally send out an alert and/or instructions to security devices in neighboring House B and House C. The security devices in House B and House C may enhance monitoring, e.g., by increasing sensitivity. For example, the security devices in House B and House C may increase the sensitivity of motion-action flood lights and/or increase the time period that the lights are left "On" once motion is detected. Additionally, security cameras devices in House B and House C which were previously set only to start recording when motion is detected may enhance monitoring by switching to constant recording for a period of time in response to receiving the alert from House A. The alert sent from House A may be a general alert. The alert sent from House A may contain additional information about the circumstances of the event indicative of a security breach. The alert sent from House A may also contain directional information regarding the event indicative of a security breach. If House B is closer to House A, than House C, House B may be alerted first based on distance associated with the attempted intrusion. Security devices closest to the detecting security devices may react more urgently than security devices which are located farther away from the original security device. Security devices associated with neighboring homes which are capable of image capturing may be rotated to detect an intruder leaving one home in order to follow the intruder's predicted path. If more events that are indicative of a security breach are detected by other security devices, in House B for example, this event becomes a new epicenter within the ad hoc network.

In one embodiment, the security device is a lock, wherein changing the state includes increasing a sensitivity thereof to security breaches.

In one embodiment, the security device is of a same type as the second security device. This configuration may include a camera to camera, lock to lock, sensor to sensor, etc. The same type as the security device may mean the same type of device and/or the same manufacturer as the first security device.

In another embodiment, the security device is at a first building, and the other second security device is at a second building. A building may be a home, business, school, office, etc. or any other enclosure to be monitored which is separated from another security device at another building. The alert may be received at a remote location. The at least one other security device may include any other security devices, mobile devices, and/or other security devices from a list of subscribers originating from the same manufacturer and/or a different manufacturer.

In a further embodiment, the security device is a lock, wherein the second security device is a lock at the same location as the security device.

An example of a plurality of security devices that are locks in the same location may occur in a locker room setting where people bring in their own padlocks. An alert from one security device (i.e. a lock within the locker room) may be sent to other security devices in the locker room upon detecting tampering and/or breach. The other security devices may change their state in response to receiving the alert.

The present invention may be a system, a method, and/or a computer program product. The computer program product may include a computer readable storage medium (or media) having computer readable program instructions thereon for causing a processor to carry out aspects of the present invention.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture (ISA) instructions, machine instructions, machine dependent instructions, microcode, firmware instructions, state-setting data, or either source code or object code written in any combination of one or more programming languages, including an object oriented programming language such as Smalltalk, C++ or the like, and conventional procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a LAN or a WAN, or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present invention.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

Moreover, a system according to various embodiments may include a processor and logic integrated with and/or executable by the processor, the logic being configured to perform one or more of the process steps recited herein. The processor may be of any configuration as described herein, such as a discrete processor or a processing circuit that includes many components such as processing hardware, memory, I/O interfaces, etc. By integrated with, what is meant is that the processor has logic embedded therewith as hardware logic, such as an application specific integrated circuit (ASIC), a FPGA, etc. By executable by the processor, what is meant is that the logic is hardware logic; software logic such as firmware, part of an operating system, part of an application program; etc., or some combination of hardware and software logic that is accessible by the processor and configured to cause the processor to perform some functionality upon execution by the processor. Software logic may be stored on local and/or remote memory of any memory type, as known in the art. Any processor known in the art may be used, such as a software processor module and/or a hardware processor such as an ASIC, a FPGA, a central processing unit (CPU), an integrated circuit (IC), a graphics processing unit (GPU), etc.

It will be clear that the various features of the foregoing systems and/or methodologies may be combined in any way, creating a plurality of combinations from the descriptions presented above.

It will be further appreciated that embodiments of the present invention may be provided in the form of a service deployed on behalf of a customer to offer service on demand.

While various embodiments have been described above, it should be understood that they have been presented by way of example only, and not limitation. Thus, the breadth and scope of a preferred embodiment should not be limited by any of the above-described exemplary embodiments, but should be defined only in accordance with the following claims and their equivalents.

What is claimed is:

1. A method, comprising:

detecting, by a security device, an event indicative of a potential security breach;

determining, by the security device, at least one other device to receive an alert indicating occurrence of the event in response to detecting the event, wherein the at least one other device is along a predicted path of a source of the potential security breach, wherein the at least one other device is located within a vicinity of the security device within a same network; and sending, by the security device, an alert indicating occurrence of the event to the at least one other device, with priority among other devices comprised in the same network because of a proximity of the at least one other device with respect to the security device, in response to detecting the event, wherein the event is indicative of an action performed on the security device, wherein the alert includes positional and/or directional information associated with the potential security breach, wherein the predicted path is derived from the positional and/or directional information, such that other devices in the same network are also aware of the potential security breach for increasing security of the other devices according to the predicted path of the source of the potential security breach.

2. The method as recited in claim 1, wherein the event is indicative of an action performed in a vicinity of the security device, wherein the action includes predetermined motions and/or sounds.

3. The method as recited in claim 1, wherein the alert is sent to at least one other security device.

4. The method as recited in claim 3, wherein the at least one other security device is of a same type as the security device.

5. The method as recited in claim 3, wherein the security device is at a first building, wherein the at least one other security device is at a second building.

6. The method as recited in claim 3, wherein the security device is a lock, wherein the at least one other security device is a lock at a same location as the security device.

7. The method of claim 3, wherein the at least one other security device originates from a different manufacturer.

8. The method as recited in claim 1, wherein the alert includes a timestamp of the event.

9. The method as recited in claim 1, wherein the alert is indicative of a probability of the event being an actual security.

10. The method of claim 1, wherein the alert is sent to a list of subscribers including the at least one other device.

11. The method of claim 1, wherein determining the at least one other device to receive the alert is based on a type of event detected.

12. The method of claim 11, wherein the type of event is selected from the group consisting of: an expected event, an actual security breach, and an attempted security breach, wherein an expected event is indicative of normal operation of the security device, wherein an actual security breach is indicative that the security device has been breached, wherein an attempted security breach is indicative of tampering but the security device remains operable.

13. The method of claim 1, wherein the action performed on the security device includes tampering with the security device, wherein tampering with the security device includes deforming the security device.

14. A computer program product, the computer program product comprising a computer readable storage medium having program instructions embodied therewith, the program instructions executable by a security device to cause the security device to:

detect, by the security device, an event indicative of a potential security breach;

determine, by the security device, at least one other device to receive an alert indicating occurrence of the event in response to detecting the event, wherein the at least one other device is along a predicted path of a source of the potential security breach, wherein the at least one other device is located within a vicinity of the security device within a same network; and send, by the security device, an alert indicating occurrence of the event to the at least one other device, with priority among other devices comprised in the same network because of a proximity of the at least one other device with respect to the security device, in response to detecting the event, wherein the event is indicative of an action performed on the security device, wherein the alert includes positional and/or directional information associated with the potential security breach, wherein the predicted path is derived from the positional and/or directional information, such that other devices in the same network are also aware of the potential security breach for increasing security of the other devices according to the predicted path of the source of the potential security breach.

15. The computer program product of claim 14, wherein the alert is sent to at least one other security device.

16. The computer program product of claim 15, wherein the security device is at a first building, wherein the at least one other security device is at a second building.

17. The computer program product of claim 14, wherein the alert is indicative of a probability of the event being an actual security breach.

18. A system, comprising:

a processor; and logic integrated with the processor, executable by the processor, or integrated with and executable by the processor, the logic being configured to:

detect an event indicative of a potential security breach of a security device;

determine at least one other device to receive an alert indicating occurrence of the event in response to detecting the event, wherein the at least one other device is along a predicted path of a source of the potential security breach, wherein the at least one other device is located within a vicinity of the security device within a same network; and send an alert indicating occurrence of the event to the at least one other device, with priority among other devices comprised in the same network because of a proximity of the at least one other device with respect to the security device, in response to detecting the event, wherein the event is indicative of an action performed on the security device, wherein the alert includes positional and/or directional information associated with the potential security breach, wherein the predicted path is derived from the positional and/or directional information, such that other devices in the same network are also aware of the potential security breach for increasing security of the other devices according to the predicted path of the source of the potential security breach.

* * * * *